United States Patent [19]

Freudenstein et al.

[11] 4,270,495

[45] Jun. 2, 1981

[54] VARIABLE DISPLACEMENT PISTON ENGINE

[75] Inventors: Ferdinand Freudenstein, Riverdale, N.Y.; E. Roland Maki, Rochester, Mich.

[73] Assignee: General Motors Corporation, Detroit, Mich.

[21] Appl. No.: 44,265

[22] Filed: May 31, 1979

[51] Int. Cl.[3] ..... F02B 75/26; F01B 31/14

[52] U.S. Cl. ..... 123/54 B; 123/78 E; 123/197 AC

[58] Field of Search ..... 123/54 R, 54 B, 48 R, 123/48 B, 53 R, 53 A, 78 R, 78 E, 78 F, 78 BA, 197

[56] References Cited

U.S. PATENT DOCUMENTS

| | | | |
|---|---|---|---|
| 1,673,280 | 6/1928 | Evans | 123/197 R |
| 2,653,484 | 9/1953 | Zecher | 123/197 R |
| 4,112,826 | 9/1978 | Cataldo | 123/48 B |

FOREIGN PATENT DOCUMENTS

| | | | |
|---|---|---|---|
| 1015857 | 10/1952 | France | 123/54 R |

*Primary Examiner*—Craig R. Feinberg
*Attorney, Agent, or Firm*—Robert J. Outland

[57] ABSTRACT

A family of balanceable, variable displacement reciprocating piston engine arrangements is disclosed. The arrangements include multiple parallel cylinders having pistons movable therein in balanceable fashion through a fixed geometry rocker mechanism driving oscillating links which are adjustable to provide control of the piston displacement and compression ratio. Both in-line and side-by-side cylinder arrangements are possible. Even firing intervals are preferably provided.

4 Claims, 4 Drawing Figures

VARIABLE DISPLACEMENT PISTON ENGINE

TECHNICAL FIELD

This invention relates to variable displacement engines and, more particularly, to balanceable engine arrangement having efficient power-transmitting and stroke-varying mechanism whereby the displacement of the pistons is varied by varying the piston stroke.

BACKGROUND OF THE INVENTION

Many types of variable stroke mechanisms have been proposed for use in engines to vary the displacement of the pistons. Recently it has again been suggested that variable displacement engines could have advantages over fixed displacement engines in the areas of both emission control and overall efficiency. However, to obtain these advantages it is necessary that the mechanical linkage used to transmit power from the engine pistons to the output shaft itself be arranged to transmit the power in an efficient manner. It is further desirable that the mechanism be balanceable within limits considered acceptable for application in automotive vehicles. U.S. Pat. No. 4,112,826 Cataldo assigned to the assignee of the present invention discloses some examples of engine arrangements proposed to provide some or all of these features.

SUMMARY OF THE INVENTION

The present invention provides novel but practical arrangements for piston engines having variable stroke and displacement mechanism capable of providing efficient operation with force and rolling moment balance and, in most cases, even firing when used in either two stroke or four stroke cycle internal combustion modes of operation. The various possible arrangements all contemplate the provision of parallel pairs of cylinders having pistons with balanced motions arranged in multiples of two to four cylinders and in either in-line or side-by-side arrangements.

These and other features and advantages of the invention will be more fully understood from the following description of certain preferred embodiments taken together with the accompanying drawings.

BEST MODE FOR CARRYING OUT THE INVENTION

Figure 1:
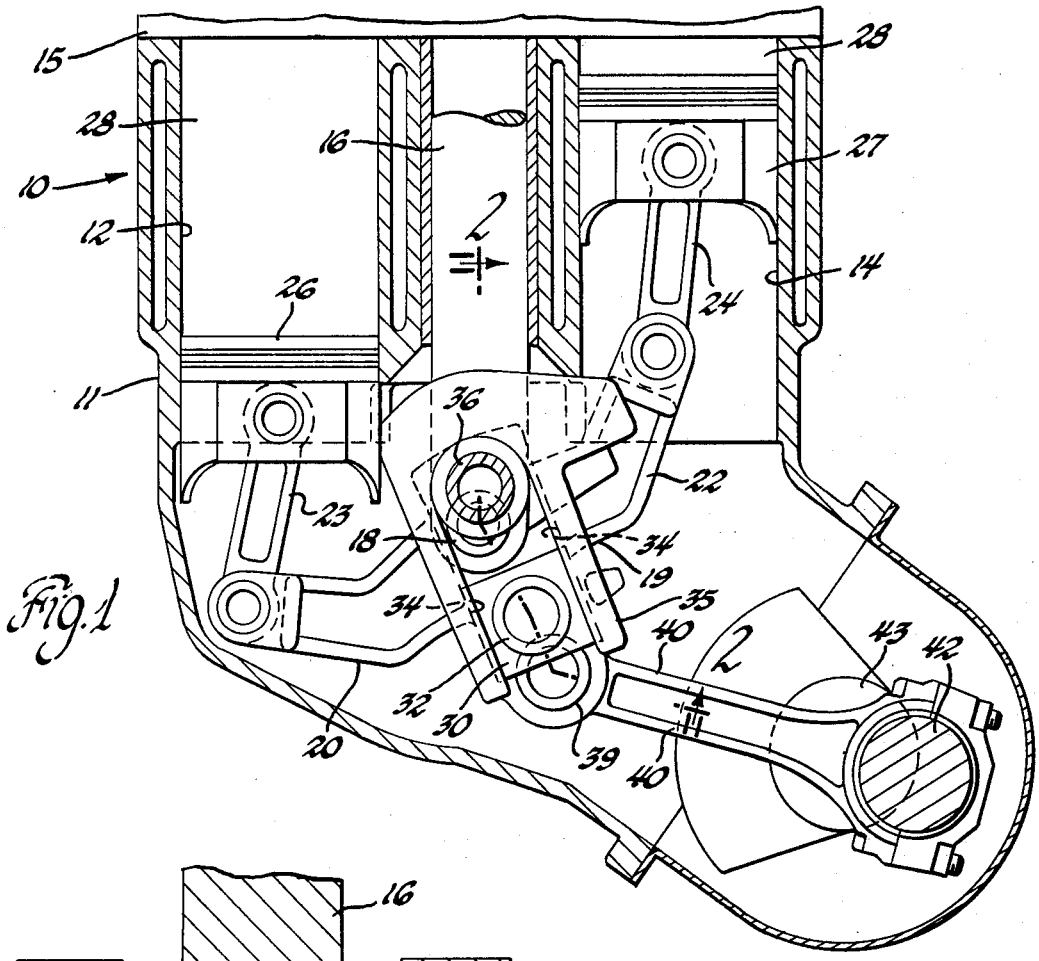
FIG. 1 is a transverse cross-sectional view through one pair of cylinders of an internal combustion engine having a variable stroke variable displacement power transmitting mechanism formed according to the invention.
Figure 2:
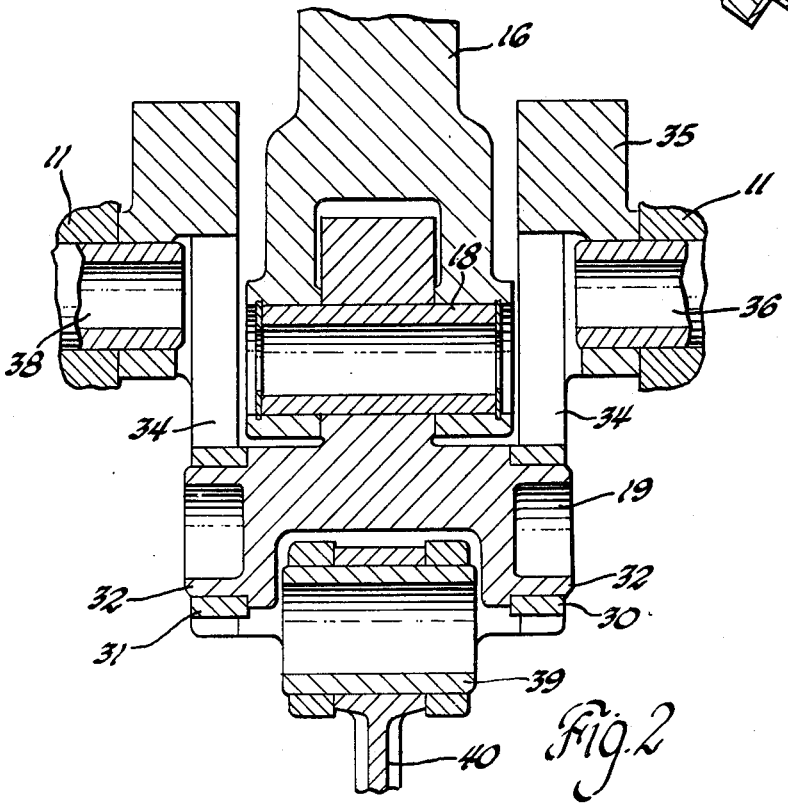
FIG. 2 is an enlarged cross-sectional view taken generally in the plane of the line 2—2 of FIG. 1 and illustrating the construction of certain portions of the variable stroke mechanism.

Referring now to FIGS. 1 and 2 of the drawings, numeral 10 generally indicates an internal combustion engine having a cylinder block 11 defining a pair of parallel cylinders 12, 14 arranged in side-by-side fashion. The cylinders are closed at one end by a cylinder head 15 which may be provided with the usual inlet and exhaust ports, valves, actuating gear and ignition means, none of which are shown.

Between the cylinders there is disposed for reciprocation parallel with the cylinder axes a stroke control actuator 16. At its bottom end, the actuator 16 oscillatingly supports by means of a pin 18 an oscillating link 19. This link includes oppositely extending arms 20, 22, the outer ends of which are operatively connected by connecting rods 23, 24 with pistons 26, 27 reciprocably disposed within the cylinders 12, 14, respectively, and forming therewith variable volume working and combustion chambers 28.

The oscillating link 19 is pivotally connected with a pair of bearing-like control blocks 30, 31 by axially aligned bearing journals 32 disposed on an axis parallel with and spaced below the axis of the stroke control actuator pin 18. The control blocks 30, 31 are slidably carried within opposed bearing surfaces 34 formed within a rocker 35 that is pivotally supported within the engine block 11 on support pins 36, 38 for oscillation on a separate longitudinal axis. The rocker is connected through a coupler pin 39 with a coupler rod 40, that, in turn, connects with the eccentric crankpin 42 of a crankshaft 43 rotatable on a longitudinal axis normal to the plane of the cylinders and parallel with the axes of oscillation of the rocker 35 and the oscillating link 19.

OPERATION

The operation of the embodiment of FIGS. 1 and 2 is as follows.

Rotation of the crankshaft 43 moves the eccentric crankpin 42 in an orbit which drives the coupler 40, causing the rocker 35 to oscillate through a predetermined constant angle around the pivot axis of its support pins 36, 38. The motion of the rocker is transmitted through the control blocks 30, 31 to the bearing journals 32 of the oscillating link causing this link to oscillate about the axis of the actuator pin 18. This oscillation, acting through the extending arms 20, 22 and connecting rods 23, 24 is converted to reciprocating motion of the pistons 26, 27 in the respective cylinders, the piston movements being in opposite directions so as to provide balance of the reciprocating components.

To adjust the stroke of the pistons and, therefore, their displacement, the stroke control actuator 16 may be raised upwardly from the maximum stroke position shown in the drawings to some reduced stroke position within the range of stroke control. This upward movement raises the pin 18 upwardly along the central axis or plane extending between the cylinders which in turn lifts the oscillating link and the pistons which are attached thereto. At the same time, however, the lower portion of the oscillating link moves within a path defined by the sliding of the control blocks 30, 31 within the bearing surfaces 34 so that in the position shown in the drawings, the angular tilt of the oscillating link is reduced. When the proper geometric relationships have been selected, this change is sufficient to offset the raising of the piston-oscillating link assembly so that the top dead center position of the pistons is properly adjusted to maintain a predetermined (probably nearly constant) compression ratio while the length of stroke of the individual pistons is reduced. In this way, variation of engine displacement with a limited prescribed change in compression ratio is provided for.

PRIMARY ENGINE BALANCE

Figure 3:
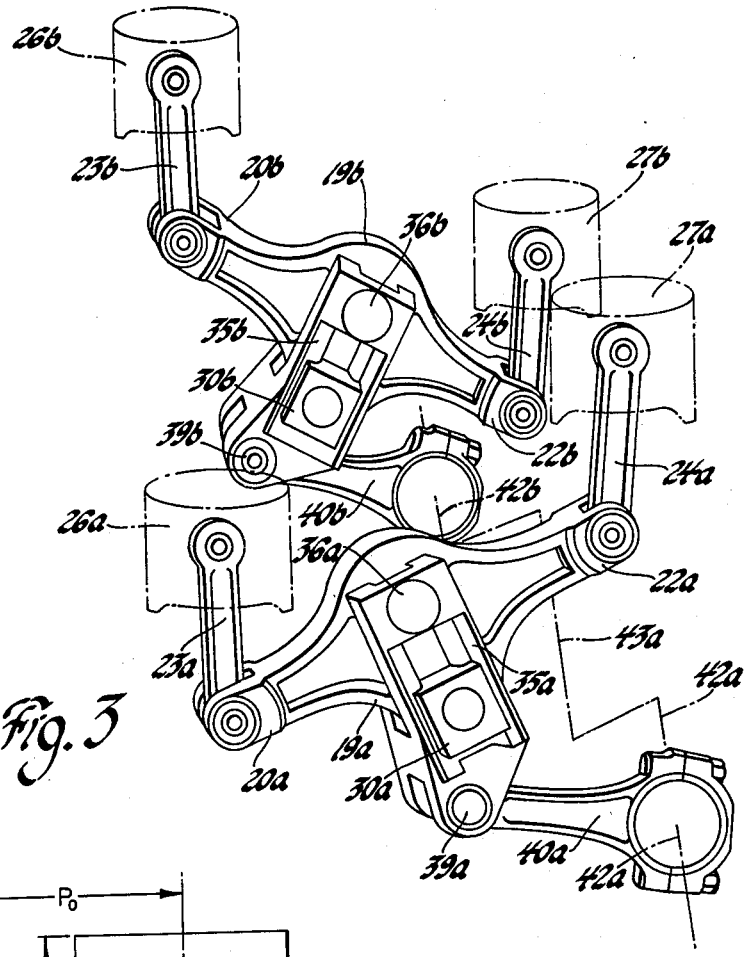
FIG. 3 is a partially diagrammatic pictorial view illustrating the arrangement of the longitudinally displaced mechanisms of a side-by-side four-cylinder engine arrangement according to the invention.

To obtain essentially complete primary balance of the major engine components without adding external balancing devices, it is necessary not only to provide oppositely moving pairs of pistons but also to provide at least one additional stroke-varying drive mechanism similar to the one previously described. Such an arrangement is shown in FIG. 3 of the drawings, wherein two pairs of mechanisms are shown connected to a crankshaft 43*a* with oppositely eccentric crankpins 42*a*, 42*b*. Since the components of each of the mechanisms shown in FIG. 3 are similar to those of the arrangement of FIG. 1, like numerals have been used to identify the similar components, with the forward mechanism components being further identified by the letter "a", while the rearward mechanism components are identified further by the letter "b".

When the engine is arranged for four-stroke cycle operation, the arrangement of FIG. 3 can provide even firing intervals between the various cylinders, since two pistons, one from each mechanism assembly, reach the top dead center position at the same time, while the others reach top dead center at alternate intervals of 180 degrees.

It should be further recognized that several other cylinder arrangements could be provided while still retaining a balance of mechanical forces. Beginning with the four-cylinder arrangement of FIG. 3, additional multiples of piston pairs and drive mechanisms can be added in groups of single mechanism, two-piston assemblies. Other force balanced arrangements may be made using multiple cylinders arranged in line with each of the pistons connected to a separate stroke control and drive mechanism. In this case, the arms 20 and pistons 26 of the various mechanisms would be deleted so that each oscillating link would have a single arm 22 connected to a single piston 27. In a four-stroke cycle engine, such an arrangement would require a minimum of four pistons and four-stroke control and drive mechanisms to obtain the desired result of operation with even firing intervals.

PREFERRED DESIGN RELATIONSHIPS

Figure 4:
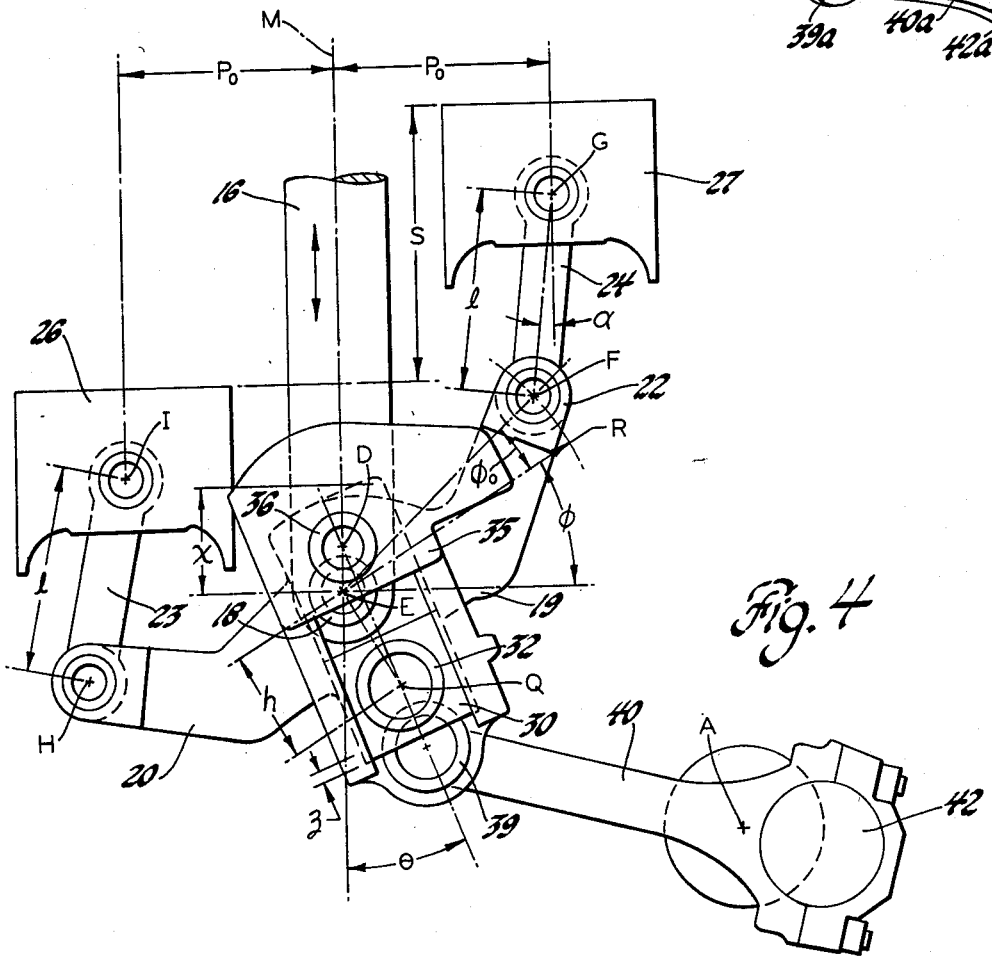
FIG. 4 is an isolated view of the engine actuating mechanism indicating relationships between the various elements.

Referring now to FIG. 4, the mechanism originally described in relation to FIG. 1 is shown with the addition of various angular and linear dimensions illustrating the physical characteristics of a preferred mechanism in accordance with the invention. Description of this figure is followed by the disclosure of specific design relationships which, if utilized, will permit the user to construct a practical engine for operation in accordance with the principles of this invention.

In FIG. 4, the components illustrated are, for simplicity, identified with the same reference numerals utilized for the identical components in FIGS. 1 and 2. In addition, certain significant rotational or pivot axes are identified by letters. These include the crankshaft rotational axis A, the rocker pivot axis D, the oscillating link pivot axis E, pivot axes of the piston connecting rods F, G, H, and I, the mechanism control axis M, and the control block pivot axis Q between the oscillating link and the control blocks.

In establishing the preferred design relationships, the following symbols are utilized.

h = distance from the oscillating link pivot axis E to the axis Q of the control blocks.

l = length of piston connecting rods from points F to G and H to I.

$C_R$ = compression ratio defined by the expression $C_R=(S+C_h)/C_h$ where S = piston stroke and $C_h$ = clearance from piston to cylinder head at top-dead-center of a stroke.

R = radius of the oscillating link from point E to point H or F.

S = stroke; the linear motion of a piston between its end points of travel at a given stroke control actuator position.

$P_o$ = distance from the mechanism central axis M to the left and right cylinder centerlines as represented by the piston pin axes G, I.

x = length of travel of the stroke control actuator along the mechanism central axis between the maximum and minimum stroke points.

$X^*$ = a nondimensional ratio equal to: x/h.

z = translational motion of the control blocks within the bearing surface guideway of the rocker over an angular oscillation of the rocker.

$\alpha$ = angularity of the piston connecting rod relative to the cylinder axis.

$\theta$ = swing angle of the rocker about its pivot axis D as measured from the mechanism central axis M.

$\phi$ = angular offset of the oscillating link in either direction from a line through the pivot axis E perpendicular to the mechanism central axis M.

$\phi_o$ = the angular offset of the axes F, H at the ends of the oscillating link from alignment with the pivot axis E. This may be equal to zero.

$\mu^*$ = a parameter between zero and one which controls the maximum deviation of the actual variation with displacement of the engine compression ratio from constant. In the present instance, a practical value of about 0.3 has been selected as appropriate for automotive vehicle application.

Using the above-identified symbols, the following design relationships are suggested for use to obtain an engine of practical proportions and operating characteristics in accordance with the invention.

1. Oscillating Link Angular Displacement $$\phi=\theta-\sin^{-1}(X^* \sin\theta)$$

2. Piston Stroke $$S=2R \sin\phi \cos\phi_o$$

3. Piston Connecting Rod Angularity $$\text{Sin}\ \alpha=R/2l\ [1-\cos(\phi+\phi_o)]$$

4. Actuator Control Travel when $\phi_o=0$ $$h = R\left\{\left[\frac{C_R+1}{C_R-1}\right]\sin\theta\,(1-\mu^*\sin^2\theta)\right\}$$

5. Approximate Control Block Sliding Motion $$z=\tfrac{1}{2}h\,X^*\,(1-X^*)\sin^2\theta$$

6. Piston Connecting Rod Length $$l = R\frac{[1 - \cos(\phi + \phi_o)]}{2 \sin \alpha}$$

7. Piston Offset From Central Axis $$P_o = \tfrac{1}{2}R[1 + \cos(\phi + \phi_o)]$$

Among the various features and advantages which may be provided in at least certain embodiments of engines in accordance with the present invention are the following.

The basic mechanism has three kinematic loops: a drive loop, a control loop and a power loop. This permits each loop to be designed for best performance without compromising the remaining loops.

The drive loop consists of a four-bar linkage including the crank, coupler and rocker and the engine block at points A and D for the ground link. Its proportions are constant for all strokes which allows its design for best force transmission, balance and minimum size consistent with the application.

The constant drive loop proportions also provide fixed crank angles for the top-dead-center positions of the pistons, which avoids the need for an auxiliary phasing device between the drive mechanism and the valve gear for timing purposes.

The stroke control actuator is guided by the engine block and moves only when necessary to change the stroke. This is an advantage relative to mechanisms which have the stroke control on a moving link. Also, the actuator motion is essentially linear over the stroke range and is continuously adjustable within this range.

The parallel cylinder construction and independent control loop permit good compression ratio control, minimum piston connecting rod angularity over the full piston stroke and control of the stroke of two cylinders with a single-stroke actuator. The side-by-side cylinder configuration is symmetrical and can be optimized for the space available in a vehicle installation while still being compact.

The eight-link mechanism includes only pin joints and sliding joints, with the sliding joints being restricted to the pistons and the stroke control blocks. The total amount of sliding in the stroke control circuit is minimized over the stroke range to limit friction loss.

The mechanism provides for equal angular increments of crankshaft rotation between power strokes of the pistons with properly selected arrangements to give equal firing intervals and a smooth flow of power to the crankshaft. The motion of the pistons is nearly sinusoidal, providing a less distorted motion pattern than the usual crank and slider arrangement of the conventional reciprocating engine.

While the invention has been disclosed by reference to certain preferred embodiments chosen for purposes of illustration, it should be understood that numerous changes could be made within the scope of the inventive concepts disclosed. Accordingly, it is intended that the invention not be limited by the disclosure but that it have the full scope permitted by the language of the following claims.

The embodiments of the invention in which an exclusive property or privilege is claimed are defined as follows:

1. A balanceable variable displacement reciprocating piston engine comprising a crank having a fixed longitudinal axis and a pair of longitudinally spaced crank arms extending in angularly opposite directions from said axis, a pair of rockers pivotable on a rocker axis parallel with said crank axis and pivotally connected at points equally spaced from the rocker axis one each with couplers each connected with one of said crank arms, said crank, couplers, and rockers forming a pair of equivalent four-bar crank and rocker linkages having opposing phase orientations, a pair of oscillating links pivotable on a link axis parallel with said rocker axis along a control plane and adjustable in said control plane which passes through the rocker axis, said links each having a portion slidably engaging one of said rockers at points spaced from said link and rocker axes so as to cause concurrent oscillation of the associated links and rockers about their respective axes, wherein a distance between said points of engagement of said links with their respective rockers and said rocker axis is adjusted by adjustment of said link axis in said control plane such that an oscillation angle traversed by said links is varied by such link axis adjustment, a pair of pistons reciprocable in cylinders on parallel axes spaced from and parallel with said control plane, and piston rods connecting each of said pistons with an extending arm of one of said oscillating links, whereby rotation of said crank reciprocates said pistons in opposite phase relation and said adjustment of said link axis varies the piston stroke.

2. A balanceable even firing four-stroke cycle variable displacement reciprocating piston internal combustion engine comprising:

a crank having a fixed longitudinal axis and at least three longitudinally spaced crank arms extending in angularly opposite directions from said axis, at least three rockers pivotable on a rocker axis parallel with said crank axis, said rockers being pivotally connected at points equally spaced from the rocker axis one each with couplers each connected with one of said crank arms, said crank, couplers and rockers forming equivalent four-bar crank and rocker linkages having balanced phase orientations, at least three oscillating links pivotable on a link axis parallel with said rocker axis along a control plane and adjustable in said control plane which passes through the rocker axis, said links each having a portion slidably engaging one of said rockers at points spaced from said link and rocker axes so as to require concurrent oscillation of the associated links and rockers about their respective axes, wherein a distance between said points of engagement of said links with their respective rockers and said rocker axis is adjusted by adjustment of said link axis in said control plane such that an oscillation angle traversed by said links is varied by such link axis adjustment, a piston associated with each oscillating link, said pistons being reciprocable in cylinders on parallel axes lying in a plane spaced from and parallel with said control plane, and piston rods connecting each of said pistons with an extending arm of its associated oscillating link, said links and crank arms being related to reciprocate the pistons at equal phase intervals in an operating cycle wherein the cylinders are fired alternately every other crank revolution, whereby rotation of said crank reciprocates said pistons in even firing phase relation with substantial balance of the moving components, and said adjustment of said link axis varies the piston stroke.

3. A balanceable even firing four-stroke cycle variable displacement reciprocating piston internal combustion engine comprising:

a crank having a fixed longitudinal axis and at least one pair of longitudinally spaced crank arms extending in angularly opposite directions from said axis, at least one pair of rockers pivotable on a rocker axis parallel with said crank axis, said rockers being pivotally connected at points equally spaced from the rocker axis one each with couplers each connected with one of said crank arms, said crank, couplers and rockers forming at least one pair of equivalent four-bar crank and rocker linkages having balanced phase orientations, at least one pair of oscillating links pivotable on a link axis parallel with said rocker axis along a control plane and adjustable in said control plane which passes through the rocker axis, said links each having a portion slidably engaging one of said rockers at points spaced from said link and rocker axes so as to require concurrent oscillation of the associated links and rockers about their respective axes, wherein a distance between said points of engagement of said links with their respective rockers and said rocker axis is adjusted by adjustment of said link axis in said control plane such that an oscillation angle traversed by said links is varied by such link axis adjustment, at least four pistons reciprocable in cylinders on parallel axes spaced from and parallel with said control plane, and piston rods connecting each of said pistons with an extending arm of one of said oscillating links, said links and crank arms being related to reciprocate the pistons in phased pairs spaced at equal intervals in a single crank revolution with the cylinders of each pair of pistons being fired alternately every other crank revolution, whereby rotation of said crank reciprocates said pistons in even firing phase relation and said adjustment of said link axis varies the piston stroke.

4. The engine of claim 3 wherein there is a pair of pistons for each oscillating link, each said link having dual oppositely extending arms and the axes of the pistons connected with each link being equally spaced on opposite sides of said control plane, said engine having a total number of pistons which is a multiple of four.

* * * * *